United States Patent [19]

Kleinman

[11] Patent Number: 5,050,244

[45] Date of Patent: Sep. 24, 1991

[54] FIREFIGHTER'S TROUSERS WITH A SELECTIVELY FOLDABLE TORSO SECTION

[76] Inventor: H. Leonard Kleinman, 9818 Mountain View Dr., Waite Hill, Ohio 44094-9310

[21] Appl. No.: 417,709

[22] Filed: Oct. 5, 1989

[51] Int. Cl.[5] ..... A41D 1/06

[52] U.S. Cl. ..... 2/227; 2/81; 2/82; 2/79; 2/236

[58] Field of Search ..... 2/227, 81, 82, 79, 80, 2/234, 235, 236, 237; D2/28

[56] References Cited

U.S. PATENT DOCUMENTS

| | | | |
|---|---|---|---|
| 849,060 | 4/1907 | Friedbaum | 2/235 |
| 1,488,536 | 4/1919 | Fry | 2/227 |
| 1,490,470 | 6/1922 | Laubach | 2/227 |
| 1,886,225 | 11/1932 | Upland | 2/227 |
| 2,197,584 | 4/1940 | Latter | 2/227 |
| 2,560,363 | 7/1951 | Navasky | 2/236 |
| 4,034,417 | 7/1977 | Ellis | 2/227 |
| 4,507,806 | 4/1985 | Coombs | 2/85 |
| 4,549,315 | 10/1985 | English et al. | 2/79 |
| 4,561,121 | 12/1985 | Ehring et al. | 2/227 |
| 4,604,759 | 8/1986 | Bowman et al. | 2/81 |
| 4,631,753 | 12/1986 | Ehring | 2/85 |
| 4,633,527 | 1/1987 | Ehring | 2/227 |
| 4,729,130 | 3/1988 | Grilliot et al. | 2/81 |
| 4,768,233 | 9/1988 | Grilliot et al. | 2/96 |
| 4,774,725 | 10/1988 | Page | 2/81 |
| 4,817,211 | 4/1989 | Grilliot et al. | 2/227 |

OTHER PUBLICATIONS

The Plain Dealer, JC Penney Back-To-School Advertisement, Sep. 1, 1989.

Bodyguard Apparel, FireFighter 3000 Series P-3000, High Waist Pant, Catalog, Lion Apparel, Inc. Dated 3-87.

*Primary Examiner*—Werner H. Schroeder
*Assistant Examiner*—Gloria Hale
*Attorney, Agent, or Firm*—Fay, Sharpe, Beall, Fagan, Minnich & McKee

[57] ABSTRACT

Trousers suitable for use by firefighters in firefighting comprise a pair of leg sections and a torso section. The top edge of the torso section extends substantially above the firefifhter's waist about the entire circumference of the firefighter's body. The top edge does not extend to the firefighter's sternum. The top portion of the torso section may be selectively folded outwardly and downwardly to provide more comfort to the firefighter during the "cool-down" period.

19 Claims, 6 Drawing Sheets

FIREFIGHTER'S TROUSERS WITH A SELECTIVELY FOLDABLE TORSO SECTION

BACKGROUND OF THE INVENTION

1. Field of the Invention

This invention relates generally to a protective trouser for use in hazardous environments, such as firefighting or working with hazardous materials, and more particularly relates to a protective trouser which, when worn in conjunction with an appropriate coat, protects the firefighter during structural firefighting.

2. Description of Related Art

Because of the hostile environment associated with fires, firefighters have need for protective garments to protect their bodies from the water, fire, heat, and other dangerous elements inherent in firefighting. These garments have traditionally taken the form of coats and trousers. An example of a protective coat is found in U.S. Pat. No. 4,507,806. Examples of protective pants are disclosed in U.S. Pat. Nos. 4,561,121 and 4,633,527. In each of these cases, the trousers are designed to be worn in a manner such that the top edge of the trousers are approximately located adjacent to the firefighter's waist.

A variation on such trouser is the bib overall, such as disclosed in U.S. Pat. No. 4,549,315. Such a bib overall design features some advantages over a traditional trouser design. Because the top edge of the bid overalls extends above the firefighter's waist, a shorter, and therefore lighter, coat can be used with the bib overalls. Fatigue is a serious concern in firefighting; therefore, a lighter jacket is a significant benefit. Because some regulations for firefighting apparel require a certain overlap between the bottom edge of the coat and top edge of the trousers or overalls, only the bib overall design affords the possibility for a shorter coat.

However, the bib overall design has certain disadvantages that heretofore have been unsolved. One disadvantage is that bib overall designs consistently require the use of suspenders. Some firefighters prefer the support of a belt to that offered by suspenders. Secondly, bib overalls partially cover the chest cavity. This puts additional strain on the heart and lungs of the firefighter. Thirdly, bib overalls are not conveniently turned down during the "cool-down" period. After the fire has been extinguished and firefighters are performing the tasks necessary to clean-up, secure the area, and return to the firehouse, it is desirable that their protective wear relieve the stress on the heart and lungs while still providing a measure of protection. Bib overalls are inconvenient and ineffective in providing such relief.

A further design is disclosed in U.S. Pat. No. 4,729,130 wherein a firefighter's coat is longer in the back than in the front. Such a design is claimed to afford lighter weight and good ventilation as compared to a jacket in which the front portion has the same length as the rear portion.

Another objective of protective garments for firefighters is that the firefighter's body remain dry and comfortable. Because the coat and trousers work in conjunction with removable or partially removable liners, it is desirable that the water associated with firefighting be prevented from seeping between the outer trousers and coats and the inner protective liners. U.S. Pat. No. 4,631,753 discloses an invention directed toward this end.

The present invention contemplates a new and improved firefighter's trouser which overcomes some of the deficiencies in previous trouser and bib designs while providing better and more advantageous overall results.

BRIEF SUMMARY OF THE INVENTION

In accordance with the present invention, a new and improved firefighter's trouser is provided which better protects the firefighter's body from the hazards of firefighting while providing a more comfortable and less stressful protective garment during cool-down periods.

More particularly in accordance with the invention, the trousers, when worn by the firefighter, comprise a pair of leg sections and a torso section. The torso section has a top edge. The top of the leg sections merge into the bottom of the torso section. The top edge of the torso section extends substantially above the firefighter's waist and about the entire circumference of the firefighter's body.

In accordance with another aspect of the invention the top edge of the torso section lies substantially in one horizontal plane so that each part of the top edge of the torso section is the same distance from the ground.

According to another aspect of the invention, the top edge of the torso section does not extend to the firefighter's sternum.

According to another aspect of the invention, the top edge of the torso section is substantially adjacent to the firefighter's 10th, 11th, and 12th thoracic vertebrae.

According to another aspect of the invention, the top edge of the torso section is between 12 and 22 inches from the point where the inside seam of one leg section meets the inside seam of the other leg section.

According to a further aspect of the invention, the invention further includes a crotch, which is the inner face where the one leg section meets the interior of the other leg section. The crotch is the lower edge of the torso section. The center of the crotch is that point where the inside seams of each leg section meet. The top edge of the torso section is between 12 and 22 inches from the center of the crotch along the line of the torso section.

According to another aspect of the invention, the top edge of the torso section is adapted to be folded outwardly and downwardly so that the point of folding is substantially at the firefighter's waist.

In accordance with a still further aspect of the invention, the trousers further comprise a slit in the torso section. The slit extends downwardly from the top edge of the torso section to a point near the crotch. A first fastening means is attached to either side of the slit for selectively holding the slit closed.

According to a still further aspect of the invention, the trousers comprise a waist seam. The waist seam extends generally horizontally around the torso section. When the top edge of the torso section is folded outwardly and downwardly, the waist seam becomes the hinge point of the fold.

According to another aspect of the invention, the first fastening means extends from a point substantially near the top edge of the torso section to a point near the crotch. The first fastening means is operatively adapted to hold closed the portion of the slit from the crotch to the firefighter's waist while allowing the portion of the slit above the waist to open and be folded outwardly and downwardly.

According to another aspect of the invention, a first pair of flame-retardant hook-and-loop strips are located on the outer surface of the torso section. One flame-retardant hook-and-loop strip is located near one corner formed by the top edge of the torso section and the slit. The corresponding strip is located on the outer surface of the torso section at a point between 2 and 6 inches below the fold.

According to another aspect of the invention, the first fastening means extends from a point near the top edge of the torso section to a point near the crotch. According to another aspect of the invention, a first fastening means holds the slit closed from a point near the firefighter's waist to a point near the crotch when the top edge of the torso section is folded outwardly and downwardly.

According to a further aspect of the invention, a belt tunnel is fixedly attached to the outer surface of the trousers and are adapted to receive a belt. The belt tunnel is positioned adjacent to the firefighter's waist where the weight of the trousers is borne by the firefighter's hips.

According to a further aspect of the invention, a moisture barrier extension for use in attaching the edge of an outer garment to the edge of an inner garment comprises a plurality of layers and fastening means. The moisture barrier extension extends downwardly and inwardly from the edge of the outer garment toward the edge of the inner garment. The innermost layer of the moisture barrier extension is interposed between the fastening means and the wearer, whereby the fastening means is prevented from contacting the wearer.

According to a still further aspect of the invention, a moisture barrier extension extends from the top edge of the torso section downwardly and inwardly. The moisture barrier extension comprises an innermost first layer of thermal-resistant material, an outermost third layer of outer shell material, and a second layer of moisture-repellent material interposed between the first and third layer. A plurality of spaced-apart snaps are fixedly attached to the moisture barrier extension. The innermost layer of thermal-resistant material covers the inward ends of the snaps, whereby the snaps are prevented from contacting the firefighter.

According to a further aspect of the invention, the trousers comprise a waist seam. The waist seam extends generally horizontally around the torso section. The waist seam is between 4 and 8 inches below the top edge of the torso section.

According to a further aspect of the invention, the top edge of the torso section is substantially adjacent to the firefighter's upper two lumbar vertebrae.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DETAILED DESCRIPTION OF THE PREFERRED EMBODIMENT

Figure 1:
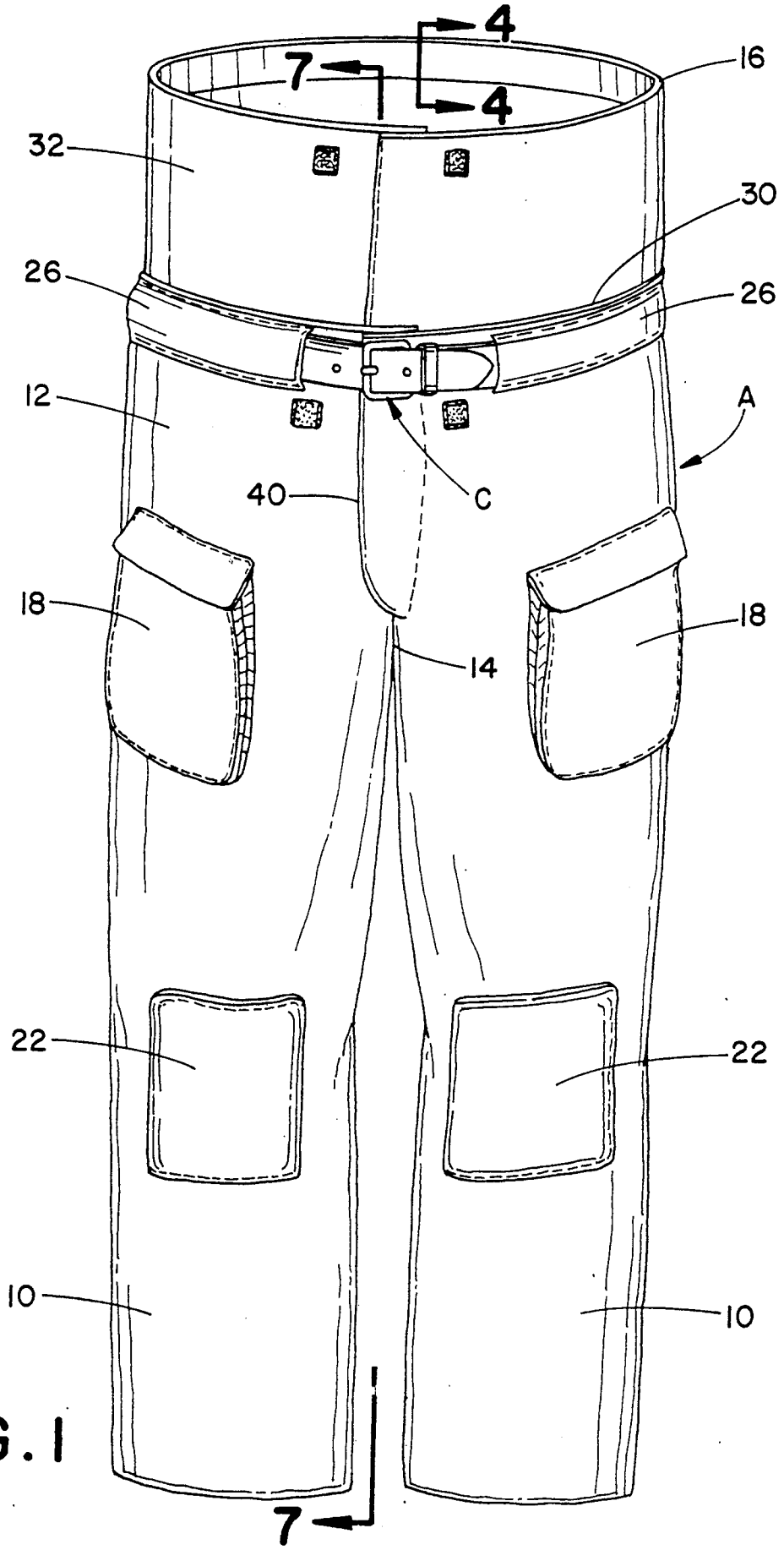
FIG. 1 is front elevational view of firefighter's trousers according to the present invention.

The invention also may be better understood in the context of the following definitions, which are applicable both the specification and to the appended claims:

"Bottom" means toward the firefighter's feet and away from the firefighter's head when the invention is being properly worn by the firefighter and the firefighter is in an upright position.

"Corresponding" means, in the context of a pair of hook-and-loop strips, that one strip is a hook strip and one strip is a loop strip so that they will cooperate together to hold together the respective surfaces to which they are attached.

"Down" means toward the firefighter's feet and away from the firefighter's head when the invention is being properly worn by the firefighter and the firefighter is in an upright position.

"Front" means toward the front of the trousers when the trousers are being properly worn by the firefighter.

"Horizontal" means a plane generally parallel to the ground when the ground on which the firefighter stands is flat.

"Inner surface" means the surface of the trousers adjacent to the firefighter's body.

"Interior of the leg section" means that portion of the leg section adjacent to the inside of the firefighter's legs. In contrast, "exterior of the leg section" means that portion of the trouser adjacent to the outer portion of the firefighter's legs, i.e. that portion of the firefighter's leg which normally is in contact with a firefighter's hands when the firefighter's arms are relaxed and hanging downwardly.

"Liner" is a garment designed to be worn underneath an outer shell, either coat or trousers, and which protects the firefighter from the moisture and elevated temperatures associated with firefighting. The liner has two primary layers, each directed toward a different function. The outer layer is primarily designed to repel moisture. The inner layer is primarily designed to protect the firefighter from heat.

"Lumbar" means of or situated in the part of the back and sides between the lowest ribs and the pelvis.

"Outer surface" means the surface of the trousers away from the firefighter's body.

"Rear" means toward the back Of the trousers when the garment is being properly worn by the firefighter.

"Sternum" is a long flat bone articulating with the cartilages and forming the mid-ventral support of most of the ribs in tetrapod vertebrates.

"Thoracic" means situated in or near the thorax. The thorax is the part of the human body between the neck and the diaphragm, partially encased by the ribs.

"Top" means toward the firefighter's head and away from the firefighter's feet when the invention is being properly worn by the firefighter and the firefighter is in an upright position.

"Up" means toward the firefighter's head and away from the firefighter's feet when the invention is being properly worn by the firefighter and the firefighter is in an upright position.

"Velcro ®" is a registered trademark of Velcro Inc. Velcro ® is one type of closure means utilizing hook and loops. Although Velcro ® is the preferred type of flame-retardant hook-and-loop strip, any other suitable flame-retardant hook-and-loop closure can be used.

"Vertebrae" means any of the bones or cartilaginous segments forming the spinal column.

Referring now to the drawings wherein the showings are for purposes of illustrating a preferred embodiment of the invention only and not for purposes of limiting same, FIG. 1 shows one embodiment of the invention. The trousers A comprise a pair of leg sections 10 and a torso section 12. The top of the leg sections terminate in a crotch 14. The crotch indicates the bottom of the torso section. The top edge 16 of the torso section represents the top of the torso section.

The trousers preferably feature an arrangement of pockets 18 and knee pads 22, although these are not necessary to practice the invention. The trousers may be made of any material suitable for the intended purpose and the material is usually chosen by regulating agencies or by the customer. One suitable material is an aromatic polyamide, such as NOMEX III ®. NOMEX III ® is a registered trademark of the E.I. DuPont De Nemours & Co.

In the preferred embodiment, the trousers are made of three layers. The first, innermost layer is a thermal barrier. The third outermost layer is an outer shell to deflect water. The second layer is a moisture barrier and is interposed between the first and third layers. All three layers can be made of NOMEX III ®.

In the preferred embodiment, belt tunnel 26 is fixedly attached to the outer surface of the trousers A. The belt tunnel is adapted to receive a belt C and is positioned adjacent the firefighter's waist. In this way, the weight of the trousers is borne by the firefighter's hips.

A waist seam 30 extends generally horizontally around the torso section 12. The waist seam is between 4 and 8 inches below the top edge 16 of the torso section. The portion 32 of the torso section between the top edge and the waist seam is lined with the same moisture and thermal barrier material used in the rest of the trousers. When the trousers are worn by the firefighter, the waist seam is substantially at the firefighter's waist.

Figure 3:
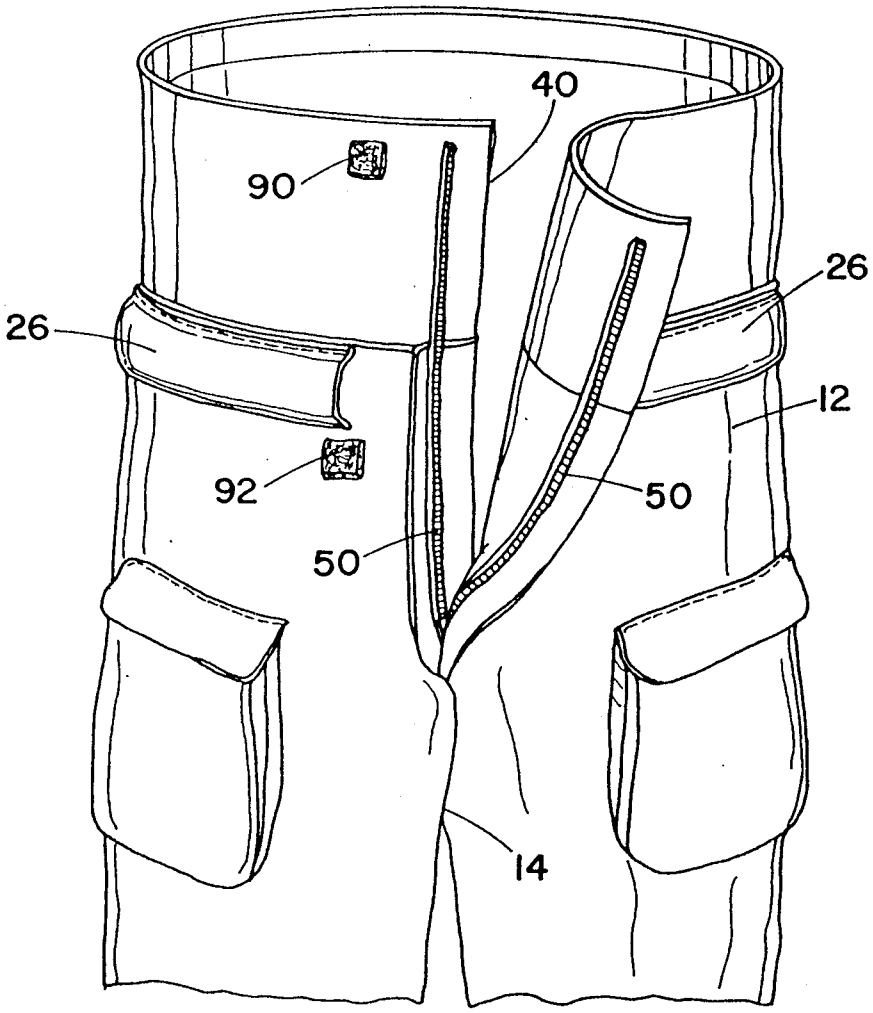
FIG. 3 is front elevational view of another embodiment of the present invention with the slit open to show the first fastening means.
Figure 2:
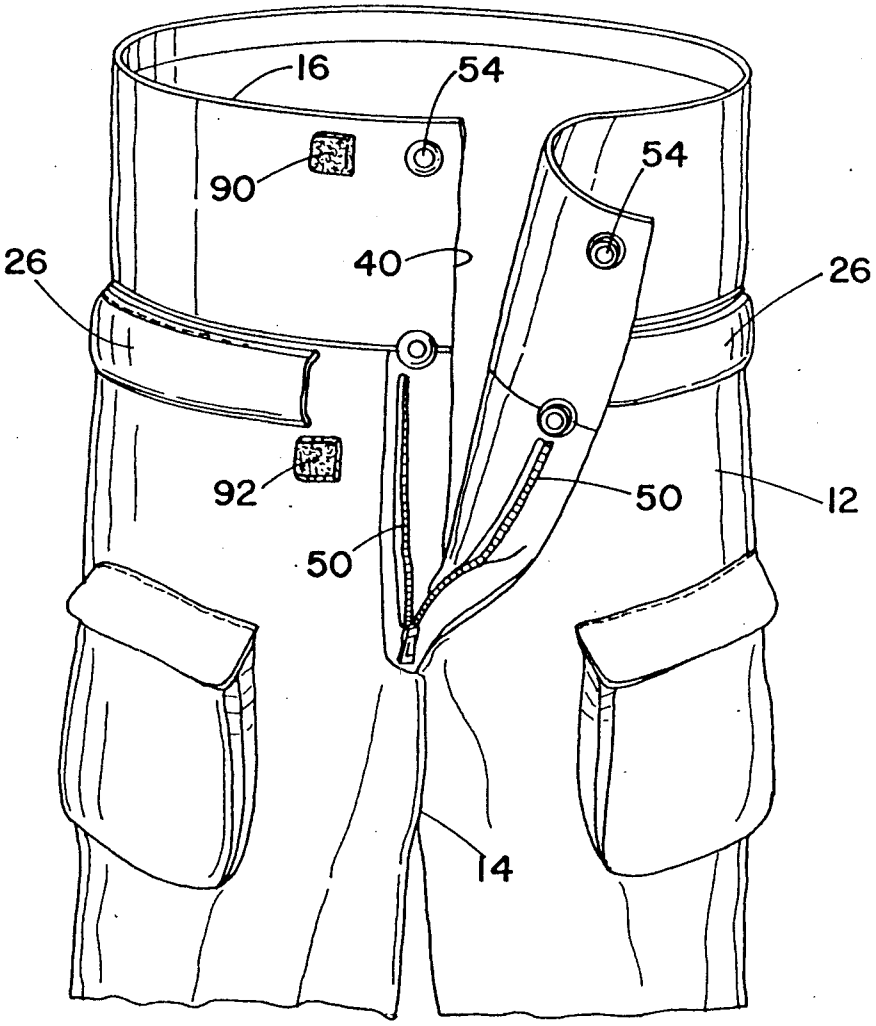
FIG. 2 is a front elevational view of one embodiment of the present invention with the slit opened to show the first fastening means.

With reference to FIG. 1, FIG. 2, and FIG. 3, a slit 40 is located in the front of the torso section 12. The slit aids in the putting on and removal of the trousers. Near the edge of the slit is a first fastening means 50. In the preferred embodiment, the first fastening means is a zipper. As seen in FIG. 3, in the preferred embodiment, the first fastening means extends from the top edge 16 of the torso section to the base of the slit near the crotch 14. In another currently unpreferred embodiment, as seen in FIG. 2, reference to the first fastening means extends from approximately the waist seam 30 to the base of the slit near the crotch. In this second currently unpreferred embodiment, second fastening means 54 is utilized to selectively hold the top edge of the torso section closed. Preferably, this second fastening means is a snap 54.

Figure 4:
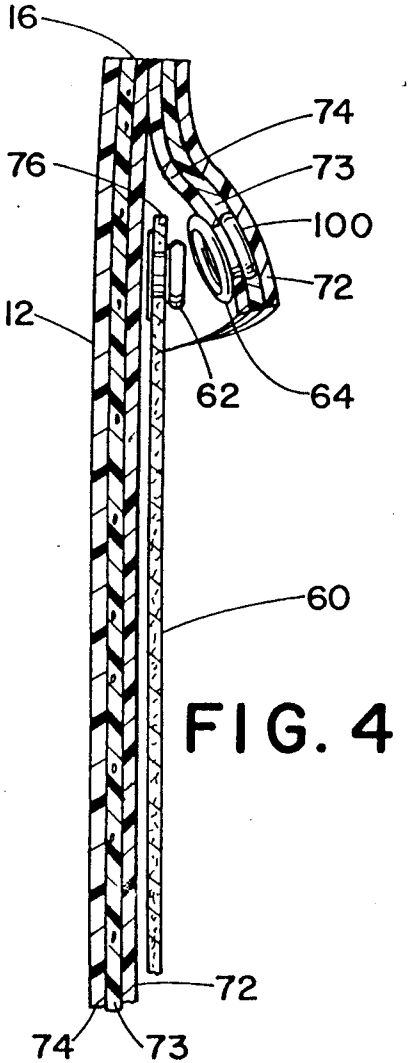
FIG. 4 is a cross-sectional schematic view taken along line 4—4 of FIG. 1 showing the moisture barrier extension.

With reference to FIG. 4, there is illustrated a cross-section of the top edge 16 of the torso section 12 of the trousers. The trouser are designed to be used in conjunction with a liner 60. The liner attaches to the trousers via fastening means. In the preferred embodiment, the fastening means is a plurality of snaps 62, 64. Also illustrated is a moisture barrier extension 70. The moisture barrier extension extends downwardly from the top edge of the torso section and creates a receptacle to receive the top edge 76 of the liner 60. The moisture barrier extension comprises three layers. A first outer layer 74 is made of an outer shell material. The second, middle layer 73 is made of a moisture repellent material. The third inner layer 72 is made of a thermal resistant material. In the preferred embodiment, these layers are all made of poly amides such as NOMEX III ®. NOMEX III ® is a registered trademark of the E.I. DuPont De Nemours & Co. The third layer 72, the thermal resistant material, covers the innermost surface 100 of the fastening means 64 so that no heat may be transferred from the environment through the fastening means to the firefighter's body.

Figure 5:
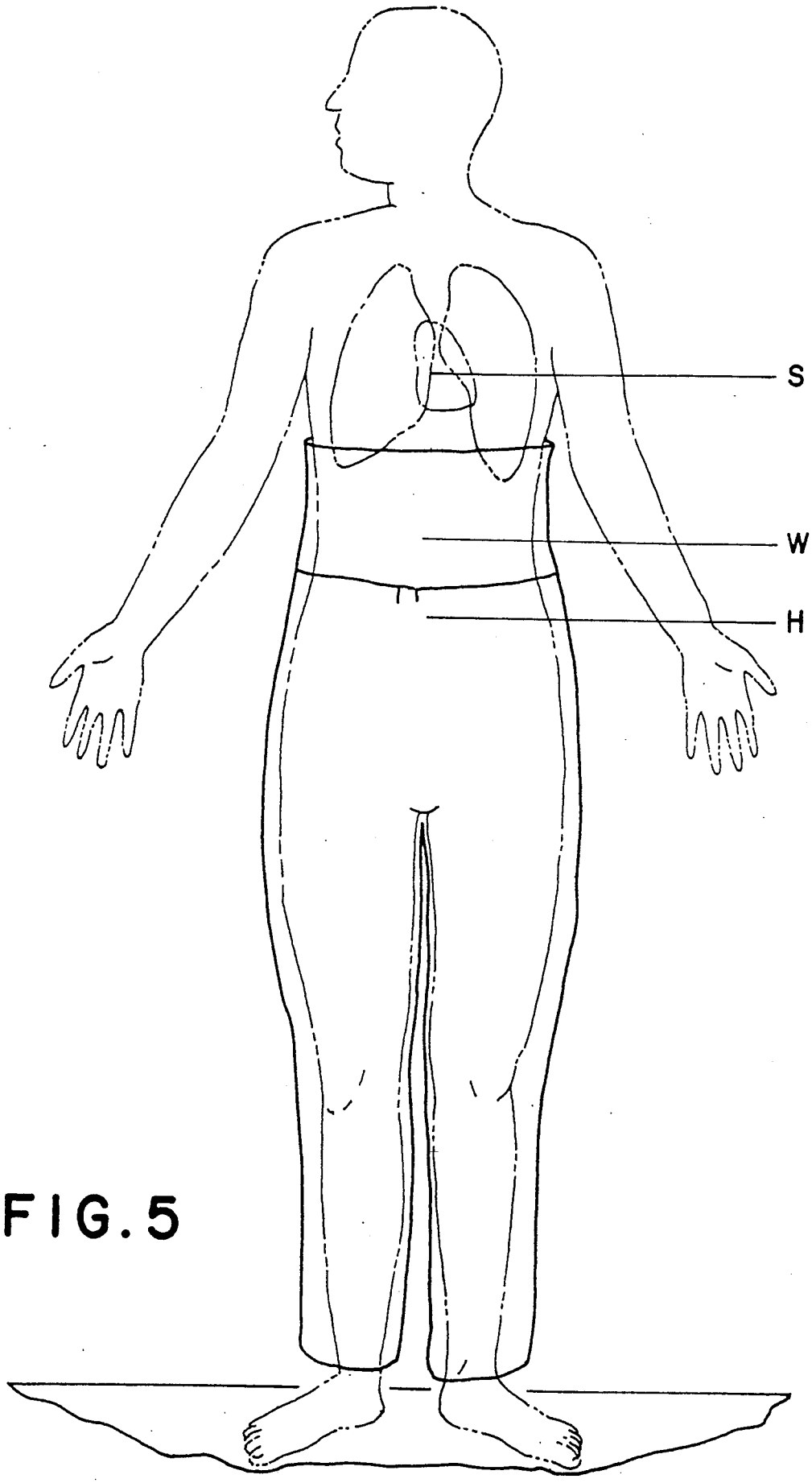
FIG. 5 is a schematic view of the outline of a human body showing the relation between the heart and lungs of the firefighter and the fitment of the present invention to the firefighter's body.
Figure 6:
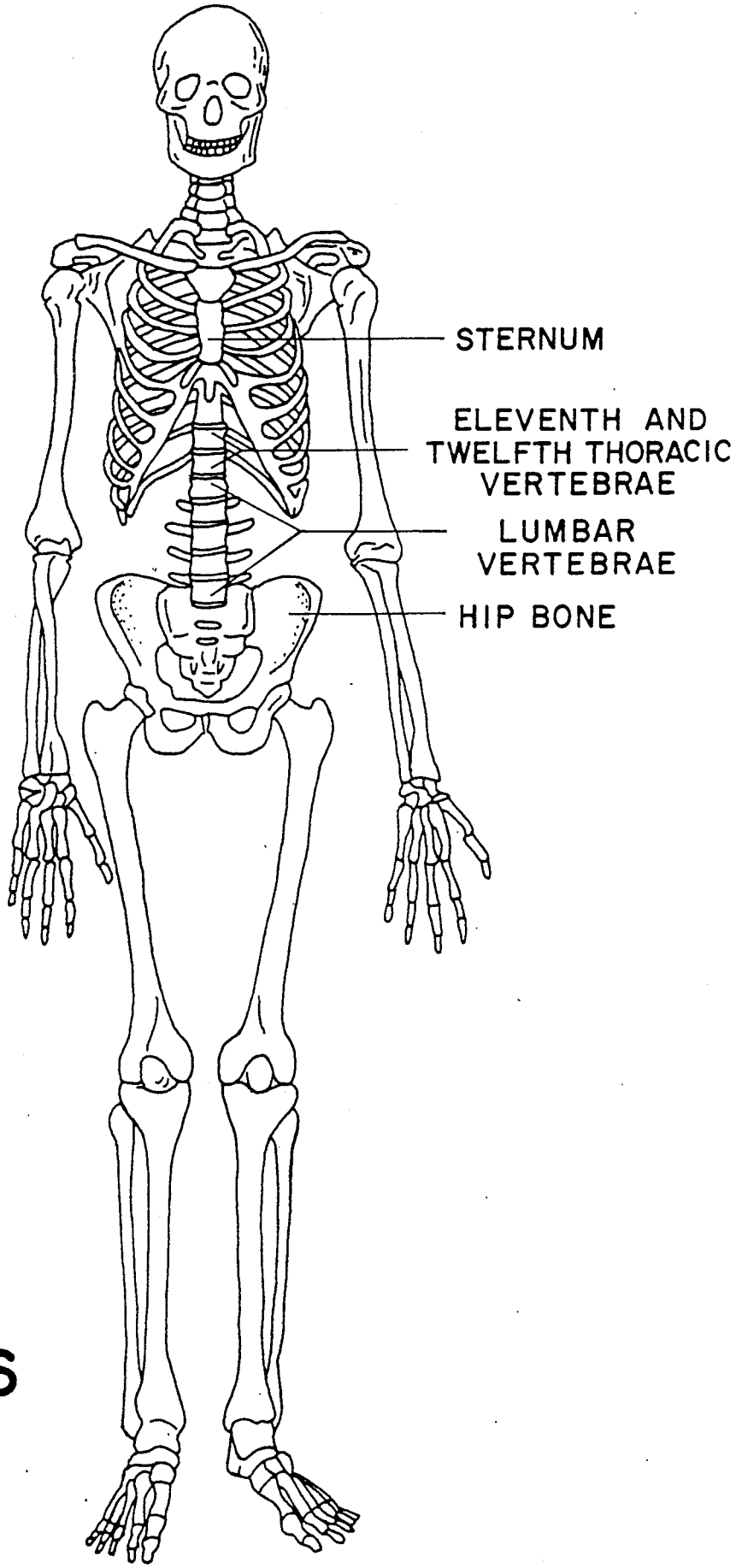
FIG. 6 is a schematic front view of a human skeleton.

One of the important features of this invention is the location of the top edge 16 of the torso section 12 in relation to the firefighter's body. With reference to FIG. 5 and FIG. 6, in the preferred embodiment, the top edge of the trousers according to the invention leaves the firefighter's lungs and heart primarily uncovered. In FIG. 5, line S represents the approximate lower edge of the firefighter's sternum. Line W represents the approximate location of the firefighter's waist. Line H represents the approximate location of the top of the firefighter's hips. Because the bodies of individual firefighter's vary, the reference point of the lower edge of the sternum and the top edge of the hips will primarily be used to show what is claimed. In conventional firefighter's trousers, the top edge of the trousers fits generally about the firefighter's waist. Because of regulations for safety equipment, an overlap between the bottom edge of the firefighter's coat (not shown) and the top edge of the trousers is specified. The use of trousers fitting about the waist necessitates the use of a longer firefighter's coat. This longer coat is necessarily heavier than a shorter coat and adds to the fatigue and stress on the firefighter's cardiovascular system.

In a bib overall design, the top edge of the front portion of the bib overall generally extends over the firefighter's heart and lungs, adding unnecessary stress on the firefighter's body. While use of the bib overall design does allow the use of a shorter coat, the firefighter's body is still unnecessarily stressed by his protective outer wear.

Figure 7:
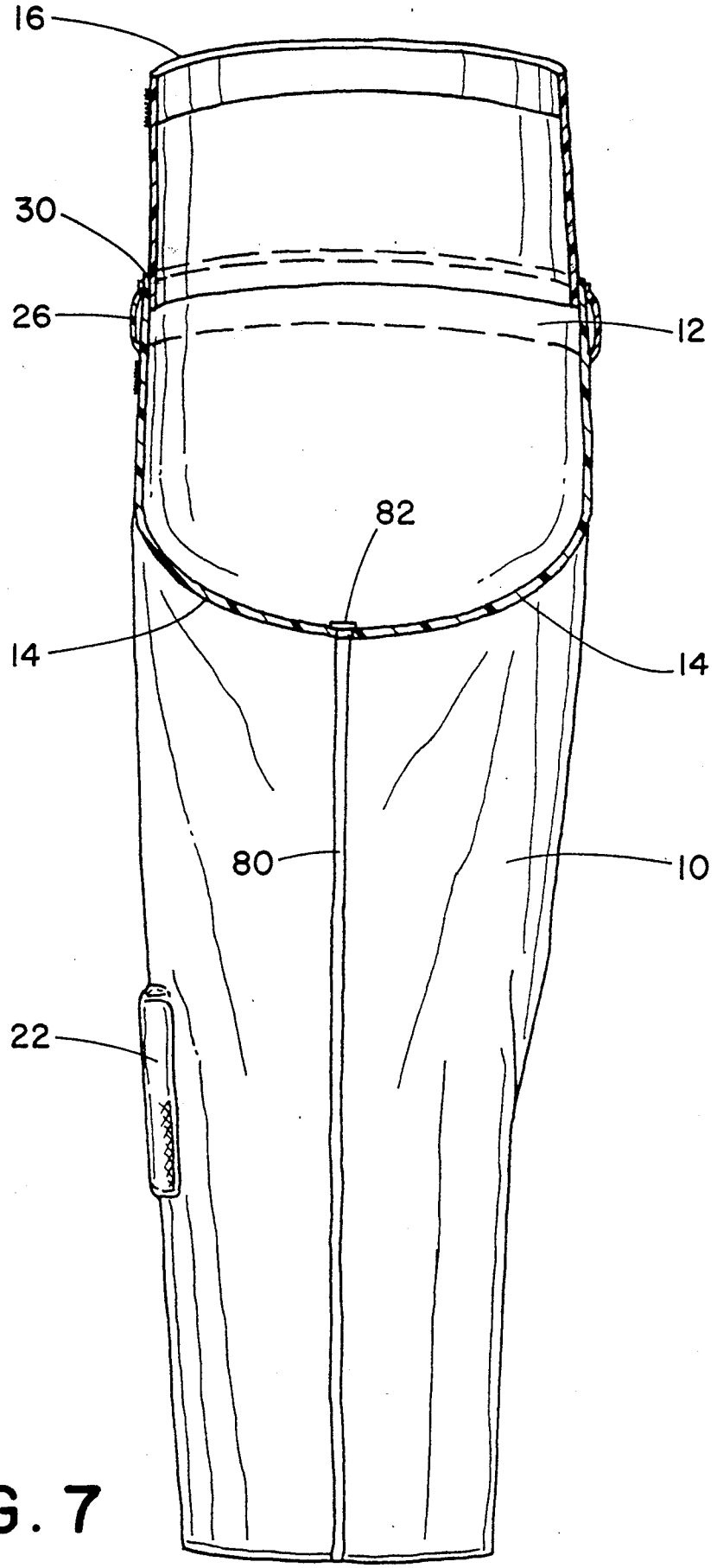
FIG. 7 is a side elevational view of the invention taken along line 7—7 of FIG. 1.

The present invention allows the use of a short firefighter's coat without covering the firefighter's heart and lungs. This provides for a more comfortable and safer protective suit. With reference to FIGS. 5-7, the top edge 16 of the torso section 12 of the present invention extends substantially above the waist of the firefighter, but below the firefighter's sternum. In a preferred embodiment, the top edge of the torso section is approximately adjacent the firefighter's 11th and 12th thoracic vertebrae. In another preferred embodiment of the invention, the top edge of the torso section of the trousers extends to the upper-most lumbar vertebrae. These vertebrae are labeled and displayed in FIG. 6.

With reference to FIG. 7, there is disclosed a side view of one embodiment of the invention. In this embodiment, the trousers are manufactured with a side seam 80. The center 82 of the crotch 14 is the point where the interior side seam 80 of the leg section 10 meets the crotch. In a preferred embodiment, the top edge 16 of the torso section 12 is 12 to 22 inches from the center of the crotch when such measurement is made forward toward the front of the trousers along the line of the fabric.

Figure 8:
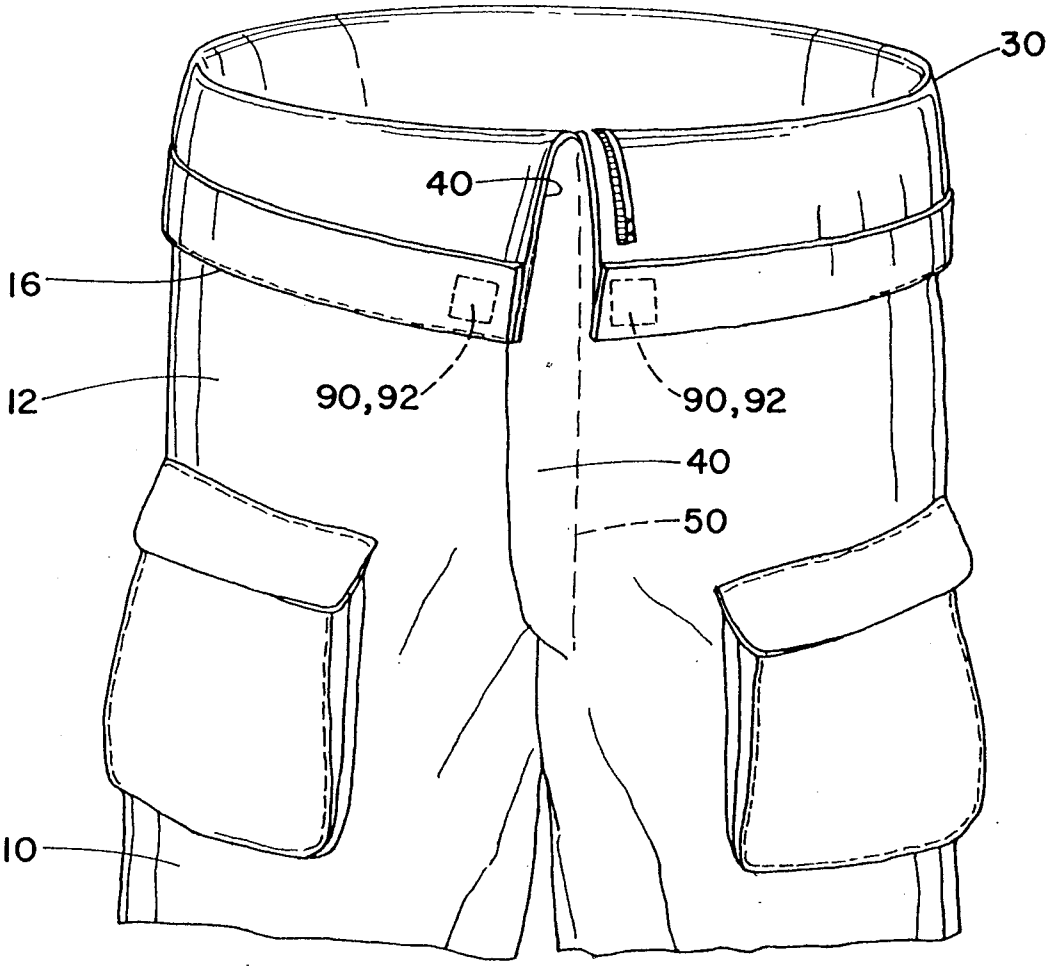
FIG. 8 is a front elevational view of the present invention with the top edge of the torso section folded outwardly and downwardly.

With reference to FIG. 8, another important feature of the present invention is the ability to fold the upper portion of the torso section 12 outwardly and downwardly during cool-down periods. The "cool-down" period is that time when the firefighter has some need of protective clothing but not as much as if he were in the midst of firefighting. This time often occurs after the fire has been extinguished, hoses are being rolled up and the area is being finally secured and cleaned up. During such circumstances, the invention provides for the upper portion of the torso section to be folded outwardly and downwardly to the firefighter's waist. In this case, the waist seam 30 becomes the hinge point for the fold. The first fastening means 50 is able to keep the slit 40 closed while allowing the upper portion of the slit to fall open. With reference to FIG. 3 and FIG. 8, in a preferred embodiment, pairs of flame-retardant hook-and-loop strips 90, 92 are provided secure the top edge 16 of the torso section 12 to the outer surface of the torso section. The preferred form of hook-and-loop strip are Velcro® strips.

While the invention has been disclosed in the form of a belt and a belt tunnel 26, the invention can also be practiced with belt loops or suspenders. The belt is preferred in that it carries the weight of the trousers on the firefighter's hips. Weight borne on the hips would also tend to relieve the stress on the firefighter's chest, heart, and lungs.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. Flame-retardant trousers suitable to be worn by firefighters in firefighting, when worn by a firefighter as intended comprising:

a pair of leg sections, each having a top and bottom;

a torso section, the torso section having a top edge, the top of the leg sections merging into the bottom of the torso section, the top edge of the torso section extending substantially above the firefighter's waist about the entire circumference of the firefighter's body, the top edge of the torso section being selectively folded outwardly and downwardly so that the hinge point of folding is substantially at the firefighter's waist.

2. The trousers of claim 1 further comprising:

a belt tunnel fixedly attached to the outer surface of the trousers to receive a belt therethrough, the belt tunnel positioned adjacent the firefighter's waist whereby the weight of the trousers is borne by the firefighter's hips.

3. The trousers of claim 1 further comprising:

belt loops fixedly attached to the outer surface of the trousers to receive a belt therethrough, the belt loops positioned adjacent the firefighter's waist whereby the weight of the trousers is borne by the firefighter's hips.

4. The trousers of claim 3 wherein the hinge point of folding is just above the belt loops.

5. Flame-retardant trousers suitable to be worn by firefighters in firefighting, when worn by a firefighter as intended comprising:

a pair of leg sections, each having a top and bottom;

a torso section, the torso section having a top edge, the top of the leg sections merging into the bottom of the torso section, the top edge of the torso section extending substantially above the firefighter's waist about the entire circumference of the firefighter's body, the top edge of the torso section being selectively folded outwardly and downwardly so that the hinge point of folding is substantially at the firefighter's waist; and, a waist seam, the waist seam extending generally horizontally around the torso section, the waist seam being the hinge point of the fold.

6. Flame-retardant trousers suitable to be worn by firefighters in firefighting, when worn by a firefighter as intended comprising:

a pair of leg sections;

a torso section, the torso section having a top edge, the top edge of the leg sections merging into the bottom of the torso section, the top edge of the torso section extending substantially above the firefighter's waist about the entire circumference of the firefighter's body, the top edge of the torso section being selectively folded outwardly and downwardly so that the hinge point of folding is substantially at the firefighter's waist;

a crotch, the crotch being the interface where the interior of one leg section meets the interior of the other leg section, the crotch being the lower edge of the torso section;

a slit in the torso section, the slit extending from the top edge of the torso section to a point near the crotch; and, a first fastening means for selectively holding the slit closed.

7. Trousers as in claim 6 where the first fastening means extends from a point near top edge of the torso section to a point near the crotch.

8. Trousers as in claim 6 wherein the first fastening means extends from a point near the firefighter's waist to a point near the crotch.

9. Trousers as in claim 7 wherein the first fastening means holds the slit closed from a point near the firefighter's waist to a point near the crotch when the top edge of the torso section is folded outwardly and downwardly.

10. Trousers as in claim 6 wherein the first fastening means extends from a point substantially near the top edge of the torso section to a point near the crotch, the first fastening means selectively holds closed the portion of the slit from the crotch to the firefighter's waist while allowing the portion of the slit above the waist to open and fold outwardly and downwardly.

11. Trousers as in claim 6 further comprising:

a first pair of flame-retardant hook-and-loop strips, one such strip located on the outer surface of the torso section near one corner formed by the top edge of the torso section and the slit, and the other corresponding strip located on the outer surface of the torso section at a point between 2 and 6 inches below the fold.

12. Trousers suitable for use by firefighters in firefighting, when worn by the firefighter comprising:

a pair of leg sections;

a torso section, the torso section having a top edge, the top of the leg sections merging into the bottom of the torso section, the top edge of the torso section extending substantially above the firefighter's waist about the entire circumference of the firefighter's body; and, a belt tunnel fixedly attached to the outer surface of the trousers to receive a belt therethrough, the belt tunnel positioned adjacent the firefighter's waist whereby the weight of the trousers is borne by the firefighter's hips.

13. The trousers of claim 12 wherein the top edge of the torso section is selectively foldable outwardly and downwardly so that the hinge point of folding is substantially at the firefighter's waist.

14. The trousers of claim 12 wherein the trousers are secured to the firefighter by the belt and belt tunnel alone.

15. A moisture barrier extension for use in attaching the edge of an outer garment to the edge of an inner garment, the moisture barrier extension extending downwardly and inwardly from the edge of the outer garment toward the edge of the inner garment, the moisture barrier extension comprising a plurality of layers and fastening means, the innermost layer interposed between the fastening means and the wearer, whereby the fastening means is prevented from contacting the wearer.

16. Trousers suitable for use by firefighters in firefighting, when worn by the firefighter comprising:

a pair of leg sections;

a torso section, the torso section having a top edge, the top of the leg sections merging into the bottom of the torso section, the top edge of the torso section extending substantially above the firefighter's waist about the entire circumference of the firefighter's body; and, a moisture barrier extension extending from the top edge of the torso section downwardly and inwardly, the moisture barrier extension comprising a plurality of layers and a plurality of spaced-apart snaps fixedly attached to the moisture barrier extension, the innermost layer of the moisture barrier extension covering the inward ends of the snaps, whereby the snaps are prevented from contacting the firefighter.

17. Trousers suitable for use by firefighters in firefighting, when worn by the firefighter comprising:

a pair of leg sections;

a torso section, the torso section having a top edge, the top of the leg sections merging into the bottom of the torso section, the top edge of the torso section extending substantially above the firefighter's waist about the entire circumference of the firefighter's body; and, a moisture barrier extension extending from the top edge of the torso section downwardly and inwardly, the moisture barrier extension comprising an inner most first layer of thermal-resistant material, an outermost third layer of outer shell material, and a second layer of moisture-repellent material interposed between the first and third layer, and a plurality of spaced-apart snaps fixedly attached to the moisture barrier extension, the innermost layer of thermal resistant material covering the inward ends of the snaps, whereby the snaps are prevented from contacting the firefighter.

18. Flame-retardant trousers suitable to be worn by firefighters in firefighting, when worn by a firefighter as intended comprising:

a pair of leg sections, each having a top and bottom;

a torso section, the torso section having a top edge, the top of the leg sections merging into the bottom of the torso section, the top edge of the torso section extending substantially above the firefighter's waist about the entire circumference of the firefighter's body; and, a waist seam, the waist seam extending generally horizontally around the torso section, the waist seam being between 4 and 8 inches below the top edge of the torso section.

19. Trousers suitable to be worn by firefighters in firefighting in conjunction with an associated firefighter's coat, the firefighter's coast extending downwardly to approximately the firefighter's hips, the trousers when worn by a firefighter as intended comprising:

a pair of leg sections; and, a torso section, the torso section having a top edge, the top edge of the leg sections merging into the bottom of the torso section, the top edge of the torso section extending substantially above the firefighter's waist about the entire circumference of the firefighter's body, the top edge of the torso section being selectively foldable outwardly and downwardly so that the hinge point of folding is substantially at the firefighter's waist.

* * * * *